United States Patent [19]

Naylor

[11] Patent Number: 4,572,449

[45] Date of Patent: Feb. 25, 1986

[54] PACKAGE MOUNTING APPARATUS

[75] Inventor: Geoffrey Naylor, Macclesfield, United Kingdom

[73] Assignee: Rieter Scragg Limited, Cheshire, United Kingdom

[21] Appl. No.: 642,888

[22] Filed: Aug. 21, 1984

[30] Foreign Application Priority Data

Sep. 28, 1983 [GB] United Kingdom ..... 8325995

[51] Int. Cl.[4] ..... B65H 54/54

[52] U.S. Cl. ..... 242/18 DD; 242/129.51

[58] Field of Search ..... 242/18 DD, 35.5 R, 129.51

[56] References Cited

U.S. PATENT DOCUMENTS

| | | | |
|---|---|---|---|
| 1,517,279 | 12/1924 | Colman | 242/18 DD |
| 2,135,485 | 11/1938 | Abbott | 242/35.5 R |
| 2,752,100 | 6/1956 | Stange | 242/18 DD |
| 3,044,733 | 7/1962 | Ingham, Jr. | 242/18 DD |
| 3,338,528 | 8/1967 | Eppendahl | 242/18 DD |
| 3,552,666 | 1/1971 | Stenmans et al. | 242/18 DD |
| 3,940,074 | 2/1976 | Laski et al. | 242/18 DD |
| 3,941,320 | 3/1976 | Strunk | 242/18 DD |
| 4,013,242 | 3/1977 | Burysek et al. | 242/129.51 |
| 4,022,390 | 5/1977 | Matas-Gabalda | 242/18 DD |
| 4,126,279 | 11/1978 | Munnekehoff | 242/18 DD |
| 4,328,928 | 5/1982 | Zang | 242/18 DD |

*Primary Examiner*—Stanley N. Gilreath

*Attorney, Agent, or Firm*—Oblon, Fisher, Spivak, McClelland & Maier

[57] ABSTRACT

A package mounting apparatus for a textile machine comprises a cradle having a pair of arms between which a package is supported. One part of one cradle arm is biassed by a spring away from the other arm but is retained during package build in a package retaining arm position. The retaining force is provided by the vibration damping means being located between the cradle arms and the mounting arms of the machine. When the package is completed, the cradle is moved to a park position using the spine of the cradle as a handle, at which position brake means are actuated to stop rotation of the package. A stop device is then released manually to allow further pivoting of the cradle, whereby the damping means become disengaged from the mounting arm so as to allow outward movement of the movable arm part and the release of the package, which drops onto supports provided on the cradle arms and is subsequently removed. An empty tube is then placed on the supports and the cradle is pivoted back to the package start position, guides moving the movable cradle arm part back into the package retaining position.

17 Claims, 10 Drawing Figures

PACKAGE MOUNTING APPARATUS

This invention relates to apparatus for mounting packages in textile machines, and in particular, though not exclusively to apparatus for mounting take-up packages in false twist texturing machinery.

Conventionally in such machines, the take-up packages are mounted in two or three vertically spaced rows extending along the length of the machine. Each package is mounted by means of a cradle, the cradles of each row being pivoted about an axis extending horizontally along the machine. Each processed yarn is brought, via a respective traverse mechanism, towards the nip between a package and a respective package driving bowl. With such an arrangement the cradle pivots as the package grows and undesirable pivotal vibration of the growing package can occur. For this reason it is conventional to provide damping means whereby such pivotal vibration is resisted. It is one object of the present invention to provide a simple but effective damping means for such application.

When a package is completed the full package must be removed from the cradle and an empty tube or mandrel is placed therein so that another package can be built. For this purpose it is conventional to provide that at least one cradle arm, or a part thereof, is pivotal relative to the remainder of the cradle in a direction away from the opposed cradle arm so as to release a package mounted between the cradle arms and enable it to be replaced by an empty tube or mandrel.

Since, for economic reasons, packages are built which are large and therefore heavy, the operation of removing full packages, from a textile machine having some 200 or more processing stations, is an arduous task for the operator. It is an object of the present invention to provide a package mounting cradle in use of which the task of removing a full package is simplified as much as possible whilst maintaining safety standards and keeping the production costs to a minimum.

The invention provides a package mounting apparatus in a textile machine comprising a cradle, said cradle having a pair of arms adapted to receive and support a package therebetween and having at least a part of at least one of said arms movable towards and away from the other of said arms, wherein said cradle is pivotal between start of package build, full package and package release cradle positions, and having biassing means operable to bias the or each movable cradle arm part away from the other of said cradle arms and retaining means operable to retain the or each movable cradle arm part in a package retaining arm position whilst said cradle is disposed between said package start, and said full package, cradle positions.

The or each movable cradle arm part may be pivotally mounted on said cradle.

The cradle may be pivotally mounted between a pair of mounting arms, in which case said retaining means may be one of said mounting arms. Cooperable guide means may be provided on said one mounting arm and said cradle arm part, adapted to guide said cradle arm part from said package release arm position to said package retaining arm position when said cradle is moved from said package release to said full package cradle position.

The cradle may include vibration damping means which may be located between the or each cradle arm and the respective mounting arm adjacent thereto, and which may comprise a friction pad supported on one and resiliently biassed into contact with the other of a cradle arm and said respective adjacent mounting arm whilst said cradle is between said package start and said full package cradle positions. Preferably a friction pad is provided between each cradle arm and the respective adjacent mounting arm. Each friction pad may be supported on a cradle arm and be resiliently biassed towards, so as to provide frictional engagement with, the respective adjacent mounting arm whilst the cradle is between the package start and full package cradle positions.

Said cradle arms may each have a support member for a package mandrel or tube provided thereon, and each support member may be formed having a concave surface directed towards a package mandrel or tube when supported between said cradle arms.

The cradle may comprise a spine having said cradle arms extending from the opposed ends thereof. Each cradle arm may have package mounting means adapted to support a package mandrel or tube provided at the free end thereof. The or each cradle arm may comprise two cradle arm parts, a first arm part extending from said spine and a second arm part pivotally secured to said first arm part and extending to the free end of said cradle arm. The respective support member many be provided on said first arm part. Said biassing means may include a compression spring disposed between said first and second arm parts.

The cradle may be mounted in a textile machine which comprises a package driving bowl and yarn guide means, said package driving bowl forming a nip with a package when mounted in said cradle arms, and said pivot axis being to that side of said nip from which a yarn is fed thereto from said yarn guide means. Preferably the yarn guide means and the pivot axis are located at the front of the machine and said package driving bowl is located rearwardly thereof, whereby a yarn is fed from the yarn guide means to the nip in a direction rearwardly of said machine.

The invention will now be described with reference to the accompanying drawings in which.

Figure 1:
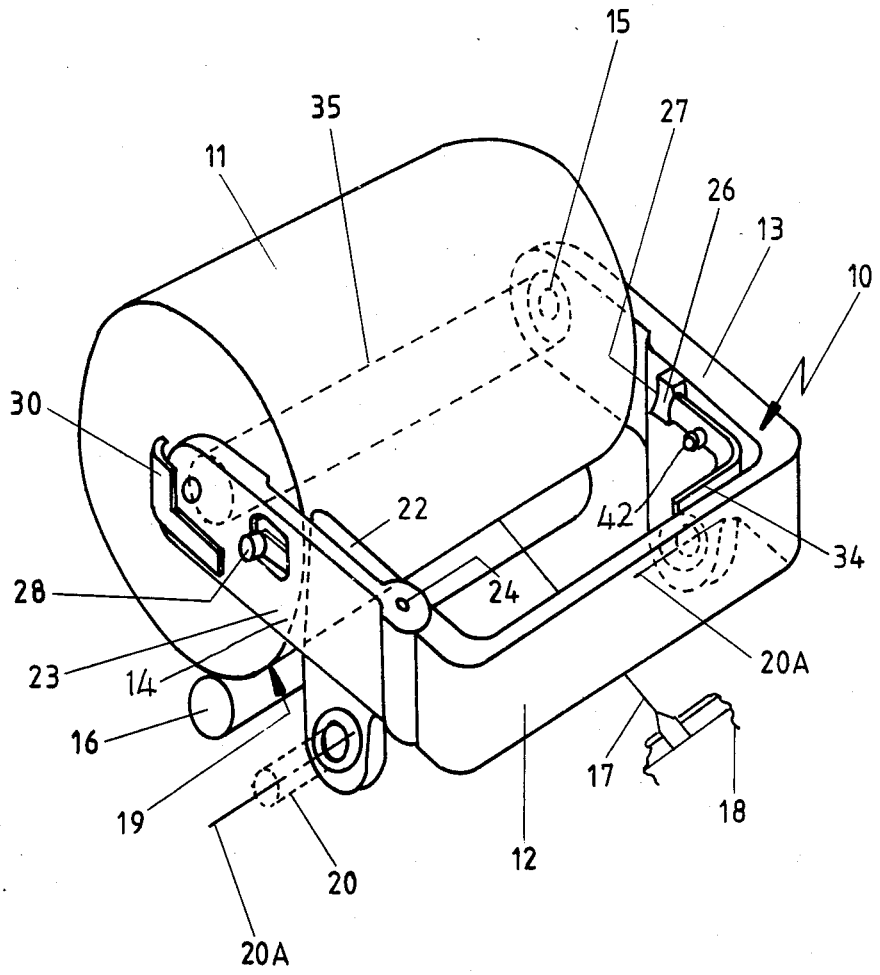
FIG. 1 is a perspective view of one embodiment of a cradle.

Referring now to FIG. 1 there is shown a package mounting apparatus comprising a cradle 10 in which a package 11 wound on a tube 35 is supported. The cradle 10 comprises a spine 12 from each end of which a cradle arm 13, 14 extends. At the free end of each cradle arm 13, 14 is a taper ended or spigotted tube locator or mounting 15. The package 11 contacts a package driving bowl 16 so as to be driven thereby and a yarn 17 is fed to the nip 19 formed between the package 11 and driving bowl 16 from a traverse guide 18 located at the front of the textile machine (not shown in FIG. 1). The traverse guide 18 is at the same side of the nip 19 as the pivot axis 20*a* of cradle 10 so that the cradle arms 13, 14 are in a trailing configuration and the yarn 17 is fed rearwardly of the machine to the nip 19. The cradle 10 is mounted by means of stub axles 20 between a pair of mounting arms 21 (omitted from FIG. 1 for clarity) of the machine so that the cradle arms 13, 14 extend generally rearwardly of the machine as the package 11 is built. The provision of stub axles 20 allows the cradle pivot axis 20*a* to be located between the spine 12 and the tube mountings 15, thereby reducing the pivot radius of package 11. The stub axles 20 are received in self-aligning bearings 41 (shown in FIGS. 2–5) provided at the free ends of the mounting arms 21. At least one of the bearings 41 may be mounted in an eccentric washer which is rotatable in the mounting arm 21 to adjust the axis of package 11 so as to be parallel with the axis of the driving bowl 16.

Figure 7:
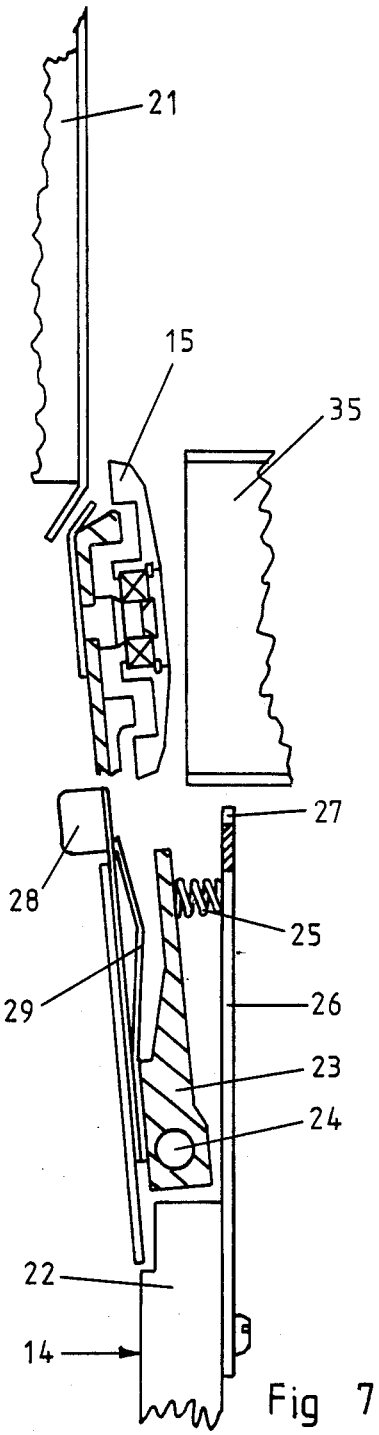
FIG. 7 is a sectional elevation of a part of the cradle of FIGS. 2–6 in the package release cradle position.
Figure 6:
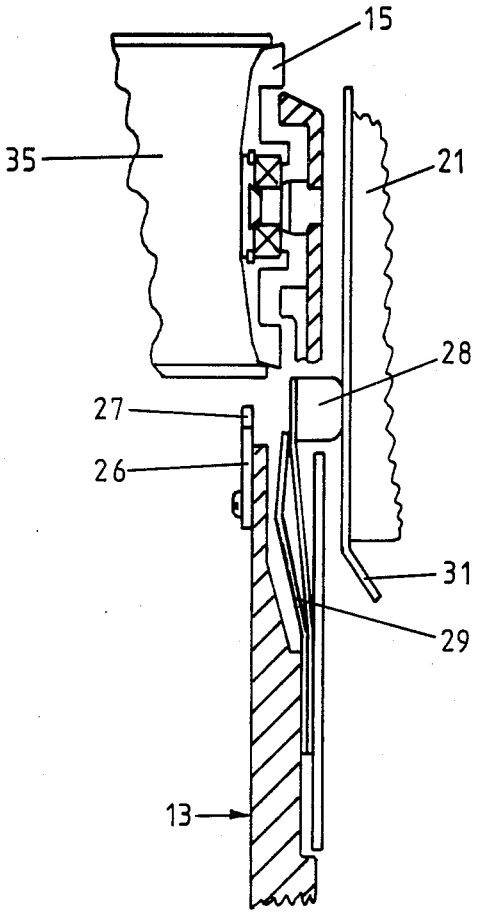
FIG. 6 is a sectional elevation of part of the cradle of FIGS. 2–5 in a position between package start and full package cradle postions.
Figure 8:
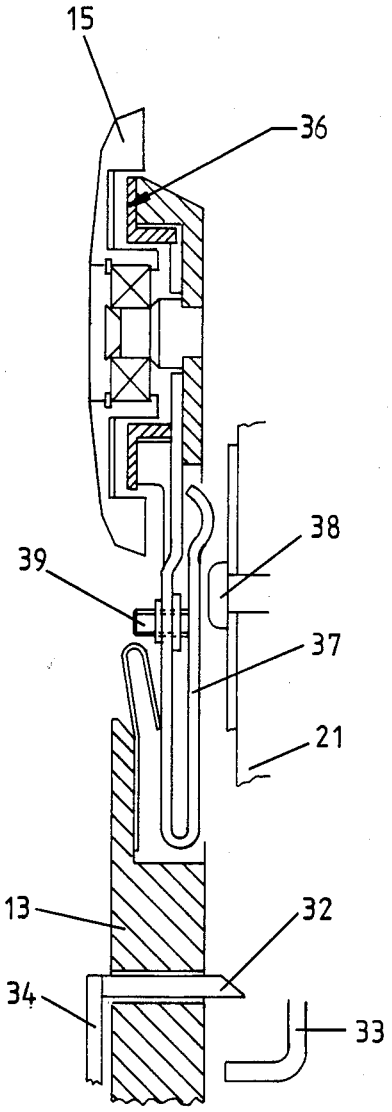
FIGS. 8 and 9 are sectional elevations of a part of the cradle of FIGS. 2–7 with the package unbraked and braked respectively.

Cradle arm 14 comprises two arm parts 22, 23. The first arm part 22 extends from the spine 12, whilst the second arm part 23 is pivotally secured at pivot 24 to the first arm part 22 and extends to the free end of cradle arm 14. The respective tube mounting 15 is provided on the second arm part 23. A compression spring 25 (FIG. 7) is provided between cradle arm parts 22, 23 to bias the second arm part 23 away from the cradle arm 13 so as to release the tube 35 from cradle 10 when arm part 23 is not constrained in the package retaining position shown in FIG. 1. On arm 13 and on arm part 22 of arm 14 there is provided a package support member 26 which has a concave surface 27 directed towards the tube 35 when supported in the cradle 10. By this means, with the cradle arms 13, 14 pivoted to a substantially vertical position when in the package release position as described below, the tube 35 with the package 11 thereon will drop from mountings 15 through a relatively small distance so that the tube 35 is supported on support members 26, from which position the package 11 may be removed at the convenience of the machine operator. On arm 13 and on arm part 23 of arm 14 there are provided friction pads 28 mounted on resilient arms 29 (FIGS. 6 and 7). When the cradle 10 is between the package start and full package cradle positions, the friction pads 28 are resiliently biased, by virtue of the resilience of arms 29, into frictional contact with the mounting arms 21 to provide damping of vibrations of cradle 10 and package 11. The resilence of arms 29 also serves to provide the restraining force on cradle arm part 23 to maintain the tube 35 located on mountings 15.

The embodiment shown in FIGS. 2–10 is generally similar to the embodiment shown in FIG. 1 except that the design of the cradle 10 is somewhat different.

Figure 5:
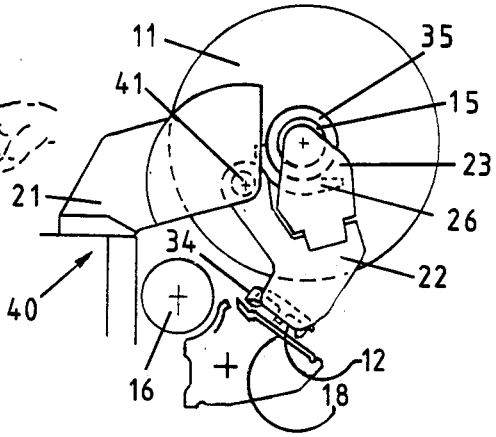

Operation of the cradle is as follows. With an empty cradle 10 in the package release cradle position as shown in FIGS. 5 and 7, the cradle arms 13, 14 extend substantially vertically. Cradle arm part 23 is in the package release arm position. An empty tube 35 is placed on the support members 26 and the cradle 10 is then pivoted, using the spine 12 as a handle, to move the tube 35 rearwardly into a textile machine 40. Guide means, in the form of a curved plate 30 (FIG. 1) attached to the free end of each cradle arm 13, 14 and a curved plate 31 (FIG. 6) attached to each mounting arm 21, cooperate to guide the free ends of the arms 13, 14 between the mounting arms 21 as the cradle 10 moves from the package release cradle position of FIGS. 5 and 7 to the full package position of FIG. 2. In particular during such movement the respective plates 30, 31 guide first arm part 22 to move inwardly against the force of compression spring 25 into the package retaining arm position shown in FIG. 1. This causes the mountings 15 to pick up the tube 35 from the support members 26 and locate it correctly between the cradle arms 13, 14. The cradle 10 is pivoted beyond the full package cradle position of FIG. 2 to the package start cradle position of FIG. 10 in which the tube 35 contacts the package driving bowl 16. During this latter pivotal movement, the resiliently biassed friction pads 28 are in contact with the mounting arms 21. The cradle arms 13, 14 now extend rearwardly of the machine 40.

The yarn 17 is then introduced to the tube 35 and the nip 19 between the tube 35 and the package driving bowl 16 to commence package build. As the package 11 grows, the cradle 10 pivots upwardly and forwardly towards the front of the machine until a full package is obtained. During the package build the friction pads 28, being resiliently biassed into frictional contact with mounting arms 21, provide damping of vibrations which could otherwise cause bouncing of the package 11 on the driving bowl 16, and also retain the package arm 23 inwardly towards arm 13 to retain the tube 35 on the mountings 15.

Figure 2:
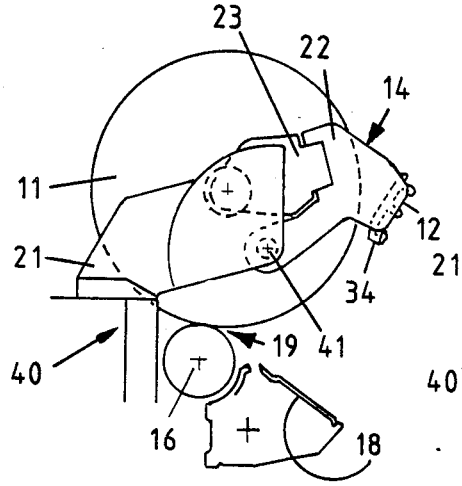
FIGS. 2–5 are end views of of a second embodiment of a cradle in a sequence of movement between full package and package release cradle positions.
Figure 3:
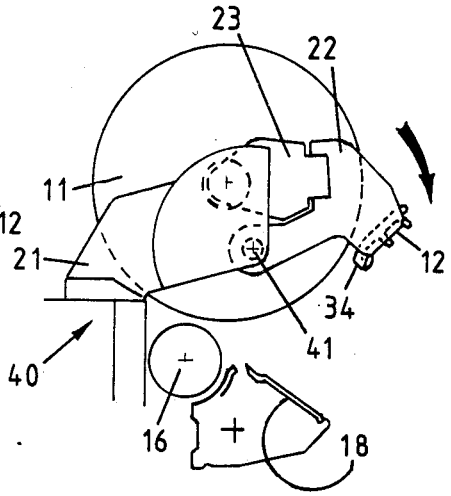
Figure 4:
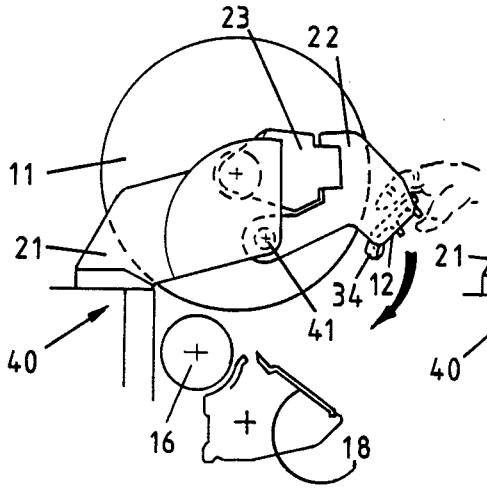

When a full package 11 is obtained, the cradle 10 is at the full package cradle position shown in FIG. 2. An indicator (not shown) indicates to the operator that the package 11 is completed, and he can then disengage the yarn and pivot the cradle 10 to the park cradle position shown in FIG. 3.

Figure 9:
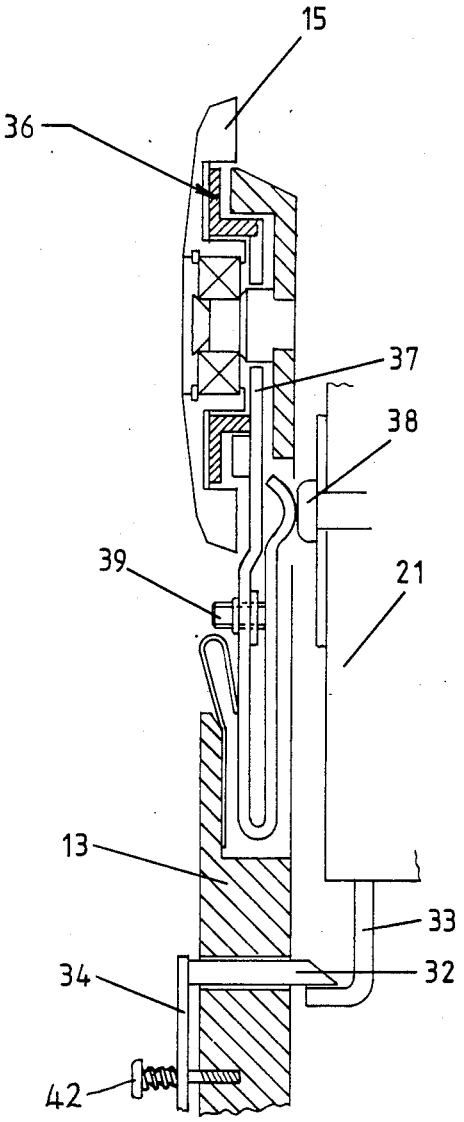

This latter movement causes the operation of a package brake (see FIGS. 8 and 9) to stop rotation of the package 11. To prevent further pivoting of the cradle 10 whilst the package 11 is rotating, stops 32, 33 (see FIGS. 8 and 9) are provided on the cradle 10 and a mounting arm 21. The brake comprises a brake pad disc 36 disposed concentrically within each mounting 15, and mounted on one end of a resilent arm 37 located within cradle arm 13 or second arm part 23. When the cradle 10 is not in the park position shown in FIG. 3, the brake pad discs 36 are out of contact with the mountings 15 as shown in FIG. 9 and the tube 35 is free to rotate. When the cradle 10 is brought into the park position of FIG. 3, the other end of each resilient arm 37 contacts a spigot 38 provided on the respective mounting arm 21 so that brake pad discs 36 are forced into contact with the mounting 15 as shown in FIG. 9. This not only provides braking of the mountings 15 but also increases the pressure between them and the tube 35 so as to reduce the tendency for the heavy package 11 and the tube 35 to continue to rotate despite the stopping of mountings 15. A set screw 39 is provided to enable the setting of the brake to be adjusted. When the package 11 has stopped rotating a lever 34 is moved (see FIG. 4) towards the spine 12 so as to pivot on a pin 42 and to retract stop 32 out of engagement with stop 33. This releases the cradle 10 so that it can be further pivoted to the package release cradle position shown in FIG. 5. This latter movement brings the cradle arms 13, 14 and friction pads 28 mounted thereon, out of contact with the mounting arms 21 so that second arm part 23 is pivoted outwardly by means of spring 25, thereby causing release of tube 35 from mountings 15. The package 11 falls through a relatively small distance so that the tube rests on the concave surfaces 27 of supports 26. The package 11 can be removed easily and the complete operation is then repeated. The operator can conveniently use the spine 12 as a hand rest whilst removing the heavy package 11 from cradle 10, the spine also serving to protect the operator's hands from the traverse guide 18 and driving bowl 16, and the traverse guide 18 from the heavy package 11.

By means of the invention, release of the completed package 11 from the cradle 10 is achieved in a quick and simple operation, without the need for the operator to release the same in a complicated manual operation. The package 11 is retained in a safe manner in the cradle 10 for subsequent two-handed removal, thereby avoiding the risk of the heavy package falling onto and/or trapping the hands of the operator. Loading of a new tube or mandrel is also quick and simple, and damping of cradle vibrations during package build is also provided in a simple, efficient and cost effective manner.

As an alternative to the springs 25 for outward pivotal movement of the cradle arm part 23, the cradle arm itself may be of a resilient material with a natural position allowing release of the tube 35 from mountings 15, or a mass pivoting arrangement may be provided which biases second arm part 23 away from the other cradle arm 13. In either case, the tube 35 is automatically released when the cradle 10 is moved beyond the park position.

With the arrangement of the present invention, the spine 12 of cradle 10 serves as a handle for pivoting the cradle 10, a package mass compensating weight, a protective shield as mentioned above, and a support for the operator's hand during doffing. The trailing nature of the cradle arms (13, 14) provides improved running stability during package build compared with the leading nature of prior arrangements, and the layout of the package mounting arrangement with the package moving to a position upward and forward when a package is completed relative to its position at which a package is started, provides easy access to the package for doffing and easy threading of a yarn from the forwardly positioned traverse mechanism to the nip between the package driving bowl and the package mandrel or tube.

In a textile machine incorporating a package mounting arrangement of the present invention, a plurality of driving bowls 16, yarn guide means 18 and respective cradles 10 are mounted in side-by-side disposition in one of several, for example three, rows, each cradle 12 in a row being independently mounted so as to pivot about a common pivot axis 20*a*.

I claim:

1. A package mounting apparatus for a textile machine, said package mounting apparatus comprising a cradle which, in use, is pivotally mounted in said machine, said cradle having a pair of arms adapted to receive and support a package therebetween, at least one of said arms having at least a part thereof movable towards and away from the other of said arms between a package retaining arm position and a package release arm position, wherein said cradle is pivotal through a first angular movement between a start of package build cradle position and a full package cradle position and through a second angular movement between said full package cradle position and a package release cradle position, said package mounting apparatus further comprising biasing means operable on said movable cradle arm part to bias said movable cradle arm part away from the other of said cradle arms towards said package release position and retaining means operable on said movable cradle arm part to retain said movable cradle arm part in said package retaining arm position whilst said cradle is disposed between said start of package build cradle position and said full package cradle position.

2. A package mounting apparaus according to claim 1 wherein the or each movable cradle arm part is pivotally mounted on said cradle.

3. A package mounting apparatus according to claim 1 wherein:

(a) said cradle is mounted between a pair of mounting arms and (b) said retaining means is provided by at least one of said mounting arms.

4. A package mounting apparatus according to claim 3 and further comprising vibration damping means disposed between at least one cradle arm and an adjacent mounting arm.

5. A package mounting apparatus according to claim 4 wherein said retaining means is provided by said damping means and comprises a friction pad supported on one and being resiliently biassed into contact with the other of a movable cradle arm part and an adjacent mounting arm.

6. A package mounting apparatus according to claim 3 and further comprising cooperable guide means provided on the or each movable cradle arm part and respective adjacent mounting arm, said guide means being in mutual contact and operable to move the or each movable cradle arm part from said package release arm position towards said package retaining arm position when said cradle is between said package release cradle position and said full package cradle position and proximate said full package cradle position.

7. A package mounting apparatus according to claim 1 wherein each cradle arm has a free end and package mounting means provided at said free end, said package mounting means being adapted to support a package mandrel or tube thereon, and each cradle arm has a support member for a package mandrel or tube provided thereon, said support member having a concave surface directed towards the package mounting means at the free end of the respective cradle arm.

8. A package mounting apparatus according to claim 7 and further comprising brake means operable to resist rotation of said package mounting means when said cradle is in a parked position disposed between said full package cradle position and said package release cradle position.

9. A package mounting apparatus according to claim 8 wherein said brake means comprises a brake pad disc disposed concentrically within each package mounting means and resiliently biassed away from the cradle arm on which said disc is mounted.

10. A package mounting apparatus according to claim 8 and further comprising releasable stop means operable to prevent pivoting of said cradle from said park position to said package release cradle position.

11. A package mounting apparatus according to claim 7 wherein said cradle comprises a spine having said cradle arms extending from the opposed ends thereof, and one or each cradle arm comprises two cradle arm parts, a first arm part extending from said spine and a second arm part pivotally secured to said first arm part and extending to the free end of said cradle arm.

12. A package mounting apparatus according to claim 11 wherein said biassing means comprises a spring disposed between said first and second cradle arm parts.

13. A package mounting apparatus according to claim 7 wherein the axis about which said cradle pivots is substantially parallel with said spine and spaced therefrom towards the free ends of said cradle arms.

14. A package mounting apparatus according to claim 13 comprising a pair of spaced cantilevered mounting arms between which said cradle is pivotally mounted, pairs of stub axles and aligned cradle pivot means provided at the free ends of said mounting arms, said cradle being mounted by means of said stub axles and said stub axles being received in said cradle pivot means.

15. A package mounting apparatus according to claim 14 wherein said cradle pivot means comprises self-aligning bearings.

16. A package mounting arrangement according to claim 1 which, in use, is pivotally mounted in a textile machine having a package driving bowl and yarn guide means, said package driving bowl forming a nip with a package when mounted in said cradle arms, said yarn guide means being operable to feed a yarn to said nip, and said pivot axis being to that side of said nip from which said yarn is fed thereto from said yarn guide means.

17. A package mounting arrangement according to claim 16 wherein said machine has a front; in which the yarn guide means and the pivot axis are located at the front of said machine and said package driving bowl is located rearwardly thereof whereby yarn is fed from the yarn guide means to said nip in a direction rearwardly of said machine.

* * * * *

UNITED STATES PATENT AND TRADEMARK OFFICE

CERTIFICATE OF CORRECTION

PATENT NO. : 4,572,449

DATED : FEBRUARY 25, 1986

INVENTOR(S) : GEOFFREY NAYLOR

Figure 10:
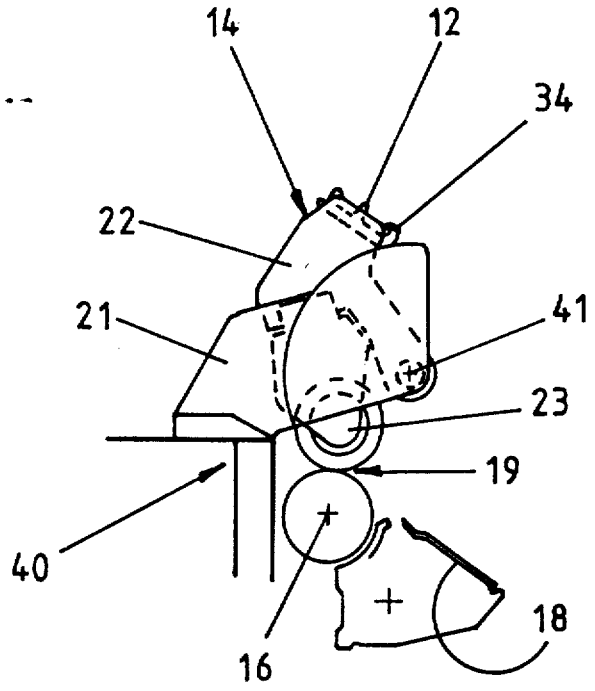
FIG. 10 is an end view similar to FIGS. 2–5 showing the cradle in the package start position.

It is certified that error appears in the above-identified patent and that said Letters Patent is hereby corrected as shown below:

The sheet of Drawing consisting of Figure 10 should be added as per attached sheet.

Signed and Sealed this

*Third* Day of *June 1986*

[SEAL]

*Attest:*

DONALD J. QUIGG

*Attesting Officer*

*Commissioner of Patents and Trademarks*